US012497674B2

(12) United States Patent
Lavigne et al.

(10) Patent No.: US 12,497,674 B2
(45) Date of Patent: Dec. 16, 2025

(54) LOW BINDER HIGH DENSITY CEMENTED CARBIDES FOR NEUTRON SHIELDING APPLICATIONS

(71) Applicant: Hyperion Materials & Technologies (Sweden) AB, Stockholm (SE)

(72) Inventors: Olivier Lavigne, Barcelona (ES); Lilian Monteil, Saint Martin d'Août (FR); Elena Tarrés Puit, Barcelona (ES)

(73) Assignee: Hyperion Materials & Technologies, Inc., Worthington, OH (US)

( * ) Notice: Subject to any disclaimer, the term of this patent is extended or adjusted under 35 U.S.C. 154(b) by 0 days.

(21) Appl. No.: 18/857,260

(22) PCT Filed: May 30, 2023

(86) PCT No.: PCT/IB2023/000692
§ 371 (c)(1),
(2) Date: Oct. 16, 2024

(87) PCT Pub. No.: WO2024/042367
PCT Pub. Date: Feb. 29, 2024

(65) Prior Publication Data

US 2025/0257434 A1 Aug. 14, 2025

Related U.S. Application Data

(60) Provisional application No. 63/482,161, filed on Jan. 30, 2023, provisional application No. 63/350,584, filed on Jun. 9, 2022.

(51) Int. Cl.

| | |
|---|---|
| ***C22C 29/08*** | (2006.01) |
| ***C22C 1/051*** | (2023.01) |
| ***C22C 29/06*** | (2006.01) |

(52) U.S. Cl.
CPC ..... *C22C 29/08* (2013.01); *C22C 1/051* (2013.01); *C22C 29/067* (2013.01)

(58) Field of Classification Search
CPC ..... C22C 29/08
See application file for complete search history.

(56) References Cited

U.S. PATENT DOCUMENTS 5,482,670 A * 1/1996 Hong ..... C04B 35/5626 75/242
2014/0322064 A1* 10/2014 Gerk ..... C22C 29/08 75/240
2019/0010583 A1 1/2019 Akesson et al.

FOREIGN PATENT DOCUMENTS

CN 105074029 A 11/2015
CN 106702192 A 5/2017
(Continued)

OTHER PUBLICATIONS

Humphry-Baker S. A. et al., "Thermal shock of tungsten carbide in plasma-facing conditions", Journal of Nuclear Materials, Elsevier B.V, Netherlands, vol. 524, Jun. 29, 2019, pp. 239-246.
(Continued)

*Primary Examiner* — Christopher S Kessler
(74) *Attorney, Agent, or Firm* — Ari G. Zytcer

(57) ABSTRACT

Provided is a low binder high density cemented carbide composition for neutron shielding including a ceramic hard phase composed of tungsten carbide (WC), sub-stoichiometric ditungsten carbide ($W_2C$), or a combination thereof, and a low weight iron (Fe)-chromium (Cr) based metallic binder phase from about 0.02 wt. % to about 2.75 wt. % based on a total weight of the cemented carbide composition. A Cr weight of the Fe—Cr based metallic binder phase may be present from about 5 wt. % to about 16 wt. % based on a total weight of the Fe—Cr based metallic binder phase. Associated methods of manufacturing a sintered low binder
(Continued)

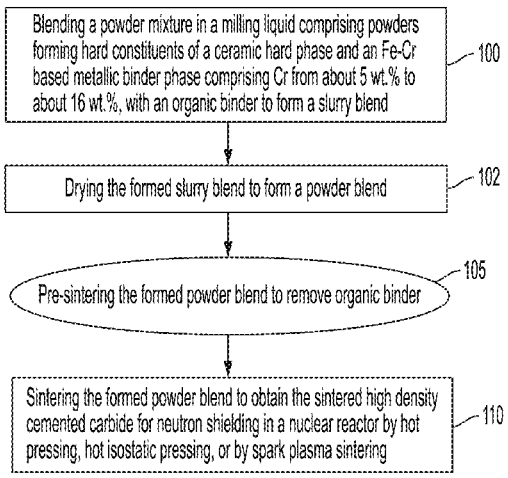

high density cemented carbide for neutron shielding are further presented.

26 Claims, 1 Drawing Sheet

(56) References Cited

FOREIGN PATENT DOCUMENTS

| | | | |
|---|---|---|---|
| CN | 108367357 | A | 8/2018 |
| CN | 109402477 | A | 3/2019 |
| JP | 2005076115 | A | 3/2005 |
| JP | 2005076115 | A1 | 3/2005 |
| TW | 201900896 | A | 1/2019 |
| WO | 2018206174 | A1 | 11/2018 |
| WO | 2023186523 | A1 | 10/2023 |
| WO | 2025061961 | A1 | 3/2025 |

OTHER PUBLICATIONS

S. Utayasekaran, E. Saiz, Jo. Meese-Marktscheffel, T. Sauberlich, S. Humphrey-Baker, "Microstructural Optimisation of WC—FeCr Neutron Shielding by Field Assisted Sintering", pp. 1852-1862, Plansee Seminar 21, Jun. 1-Jun. 6, 2025, Reutte, Austria.

* cited by examiner

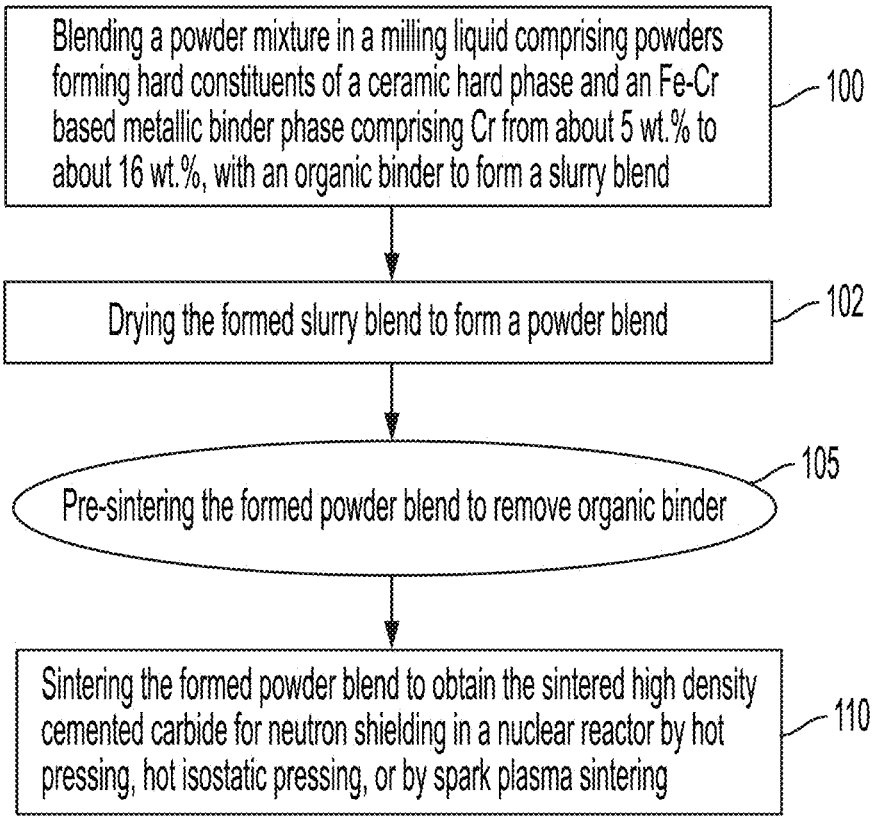
Blending a powder mixture in a milling liquid comprising powders forming hard constituents of a ceramic hard phase and an Fe-Cr based metallic binder phase comprising Cr from about 5 wt.% to about 16 wt.%, with an organic binder to form a slurry blend
100
Drying the formed slurry blend to form a powder blend
102
Pre-sintering the formed powder blend to remove organic binder
105
Sintering the formed powder blend to obtain the sintered high density cemented carbide for neutron shielding in a nuclear reactor by hot pressing, hot isostatic pressing, or by spark plasma sintering
110

LOW BINDER HIGH DENSITY CEMENTED CARBIDES FOR NEUTRON SHIELDING APPLICATIONS

This is a National Phase Application filed under 35 U.S.C. 371 as the national stage of PCT/IB2023/000692 filed on May 30, 2023, an application claiming the benefit of U.S. Application No. 63/350,584 filed on Jun. 9, 2022 and U.S. Application No. 63/482,161 filed on Jan. 30, 2023, the entire contents, of which, are hereby incorporated by reference in their entirety.

FIELD OF THE DISCLOSURE

The present disclosure relates to low binder high density cemented carbide compositions, and to associated methods of manufacturing low binder high density cemented carbides for neutron shielding.

BACKGROUND

When designing any type of nuclear reactor, it is elementary that the point of focus is to consider how the reactor components should be protected from the magnitude of the neutron flux and the gamma rays generated by the nuclear reactor during fission and the fusion reactions. In terms of radiation shielding, there is an overall need for an efficient biological shield, which also includes other parts of the reactor, such as, for example the electronic systems. A prerequisite is that the shielding material should be tailored to provide protection against a wide range of highly energetic radioactive radiation species including, e.g., α-particles, β-particles, γ-rays, and neutrons over a short distance. These conditions place strict restrictions on the type of materials, which can be used during the designing stages of a nuclear reactor. It is also key that the material forming the shielding itself is resistant to activation and does not itself transform to other harmful radioisotopes when being irradiated. This means that materials containing significant quantities of, e.g., nickel (Ni) and cobalt (Co) generally cannot be used for this purpose, since these pose activation hazards when being irradiated, as they undesirably possess extremely long radioactive half-lives for elimination from the environment.

Small modular fusion nuclear reactors and magnetic confinement reactors have emerged as popular choices of use for next generation nuclear power plants. At its core, small modular nuclear plants favorably possess the potential benefit of being safer and more efficient than the large nuclear power plants that are currently in use. On the downside, in the case of magnetic confinement fusion reactors, these are reliant on cryogenically cooled copper and/or High Temperature Superconductors (HTS) to generate a magnetic field. Thus, the space between the plasma chamber and the cold conductors (copper/HTS) is rather limited. In both cases, these types of reactors pose a challenge when considering the choice of material for radiation shielding, since the geometry of such reactors means that space is indeed rather limited. In consequence of this, the shielding material must logically be applied in thin layers, while still maintaining the neutron shielding capacity.

Therefore, the challenge is to find an alternative shielding material that does not need to be applied in excessively large thicknesses to achieve a satisfactory shielding effect. Moreover, the material should also not form any hazardous by-products from the exposure to the nuclear fusion process. It is therefore imperative that the materials cannot contain concomitant elements, which would transmute to harmful radionuclides, such that it would impede the decommissioning and refueling stages of the nuclear reactor at the end of a duty cycle. What is more, a core aspect, is that it should also be possible to manufacture the materials to be used for this application using conventional techniques without involving multiple cumbersome steps.

The most attractive materials in this regard would be high-density materials further with the capacity of displaying high corrosion and oxidation resistance. Hence, it is crucial that neutron shielding materials for nuclear applications exhibit a high density to efficaciously quell by capturing the neutron fluxes produced in the nuclear reactors. Apart from this, they should be made of elements having a short radioactive half-life to avoid complex decommissioning procedures at the end of the reactor's life and complex storage facilities for irradiated materials. Lastly, as stated, it is instrumental that they should be corrosion- and oxidation-resistant since they are continuously exposed to cooling media during the operation of nuclear reactors.

Of note, the properties of cemented carbides primarily depend on metallic binding phase content and tungsten carbide (WC) grain size. To that end, typical WC-cobalt (Co) or WC-nickel (Ni) cemented carbides may contain from about 2 wt. % up to about 30 wt. % Co or Ni based on a total weight of the cemented carbide, and the WC grain size may typically range from submicron levels to a few microns. The binding phase, such as Co or Ni is favorable for facilitating a robust fracture toughness and a strength increase, but at the same time, the metallic binding phase will also undesirably reduce the corrosion-resistance, the wear-resistance, and the hardness of cemented carbides. Thus, an increase in the fracture toughness and the strength at the expense of a reduction in the corrosion-resistance, the wear-resistance, and the hardness therefore remains a non-trivial trade-off. What is further noteworthy, is that, because of the differences in the thermal expansion coefficient compared to WC, cobalt for instance also causes unwanted thermal stress, which therefore logically limits its application at high temperature and otherwise harsh conditions. Hence, in the ongoing quest for solutions for mitigating at least the foregoing, low binder cemented carbides have therefore naturally attracted intensified research attention and efforts. Growing body of evidence spawned from the conducted research suggests that low binder cemented carbides in this regard exhibit stellar physical properties, such as for example a robust wear-resistance, increased corrosion-resistance, and improved hardness due to containing a low amount of the metallic binder. Consequently, over the years, this has sparked a conceivable mounting interest in limiting the addition of an unduly high concentration of metallic binders during the manufacturing stages of cemented carbides to ultimately increase their corrosion resistance.

International patent publication number WO2018206174A1, which is incorporated herein by reference in its entirety, relates to cemented carbides including an iron-chromium (Fe—Cr)-based metallic binder employed for manufacturing a cutting tool, a wear part, a seal ring, a bushing, a component of an automotive, a die, or a tool for handling radioactive material. However, in this case, the cemented carbides disclosed in WO2018206174A1 are not optimized for handling radioactive material, because the metallic binder content exceeds 3 wt. %, thus decreasing the final density of the material, thereby essentially hindering its neutron shielding potential and capacity. Moreover, the use of sub-stoichiometric ditungsten carbides like for instance $W_2C$ to increase the material density is also not disclosed in WO2018206174A1.

Thus, taking the foregoing into consideration there is a need for low binder high density cemented carbide compositions displaying improved corrosion-resistance and an acceptably short radioactive half-life activity for neutron shielding in nuclear reactors.

SUMMARY

According to a first aspect, provided is a low binder high density cemented carbide composition for neutron shielding in a nuclear reactor including a ceramic hard phase and an iron (Fe)-chromium (Cr) based metallic binder phase. A weight of the Cr may be from about 5 wt. % to about 16 wt. % based on a total weight of the Fe—Cr based metallic binder phase.

Optionally, a weight of the chromium is from about 10.5 wt. % to about 16 wt. % based on a total weight of the Fe—Cr based metallic binder phase.

Optionally, a weight of the chromium is from about 10.5 wt. % to about 10.7 wt. % based on a total weight of the Fe—Cr based metallic binder phase.

Optionally, the cemented carbide composition may include from about 0.02 wt. % to about 2.75 wt. % of the Fe—Cr based metallic binder phase based on a total weight of the cemented carbide composition.

Optionally, the cemented carbide composition includes about 2.75 wt. % of the Fe—Cr based metallic binder phase based on a total weight of the cemented carbide composition.

Optionally, the ceramic hard phase includes tungsten carbide (WC), sub-stoichiometric ditungsten carbide ($W_2C$), or a combination thereof.

Optionally, the ceramic hard phase includes WC.

Optionally, the ceramic hard phase includes sub-stoichiometric $W_2C$.

Optionally, the ceramic hard phase includes a combination of WC and sub-stoichiometric $W_2C$ in a ratio of 1:1.

Optionally, the cemented carbide composition may include from about 97.25 wt. % to about 99.98 wt. % of the ceramic hard phase based on a total weight of the cemented carbide composition.

Optionally, the cemented carbide composition has a theoretical density from about 15.25 g/cm$^3$ to about 17 g/cm$^3$.

Optionally, a cemented carbide composition with improved corrosion resistance is obtained.

Optionally, the Fe—Cr based metallic binder phase is made by blending a FeCr powder with a $Cr_3C_2$ powder.

Optionally, the cemented carbide composition has an HV30 Vickers hardness in a range of from about 2227 HV30 to about 2700 HV30 and a Palmqvist fracture toughness ($K_{Ic}$) in a range of from about 5 MPa√m to about 7.6 MPa√m.

Also provided is a method of manufacturing a sintered low binder high density cemented carbide for neutron shielding in a nuclear reactor including blending a powder mixture in a milling liquid including powders forming hard constituents of a ceramic hard phase and an iron (Fe)-chromium (Cr) based metallic binder phase comprising chromium from about 5 wt. % to about 16 wt. % based on a total weight of the Fe—Cr based metallic binder phase, with an organic binder to form a slurry blend. Next the formed slurry blend is dried to form a powder blend. Finally, the formed powder blend is sintered to obtain the sintered low binder high density cemented carbide for neutron shielding.

Optionally, a weight of the chromium is from about 10.5 wt. % to about 16 wt. % based on a total weight of the Fe—Cr based metallic binder phase.

Optionally, a weight of the chromium is from about 10.5 wt. % to about 10.7 wt. % based on a total weight of the Fe—Cr based metallic binder phase.

Optionally, the cemented carbide may include from about 0.02 wt. % to about 2.75 wt. % of the Fe—Cr based metallic binder phase based on a total weight of the cemented carbide.

Optionally, the cemented carbide includes about 2.75 wt. % of the Fe—Cr based metallic binder phase based on a total weight of the cemented carbide.

Optionally, the ceramic hard phase includes tungsten carbide (WC), sub-stoichiometric ditungsten carbide ($W_2C$), or a combination thereof.

Optionally, the ceramic hard phase includes WC.

Optionally, the ceramic hard phase includes sub-stoichiometric $W_2C$.

Optionally, the ceramic hard phase includes a combination of WC and sub-stoichiometric $W_2C$ in a ratio of 1:1.

Optionally, the cemented carbide may include from about 97.25 wt. % to about 99.98 wt. % of the ceramic hard phase based on a total weight of the cemented carbide.

Optionally, the cemented carbide has a theoretical density from about 15.25 g/cm$^3$ to about 17 g/cm$^3$.

Optionally, a cemented carbide with improved corrosion resistance is obtained.

Optionally, the Fe—Cr based metallic binder phase is made by blending a FeCr powder with a $Cr_3C_2$ powder.

Optionally, the cemented carbide has an HV30 Vickers hardness in a range of from about 2227 HV30 to about 2700 HV30 and a Palmqvist fracture toughness ($K_{Ic}$) in a range of from about 5 MPa√m to about 7.6 MPa√m.

Optionally, drying the slurry blend includes vacuum drying, air drying, freeze drying, or spray drying through atomization.

Optionally, the sintering includes hot pressing (HP), hot isostatic pressing (HIP), or spark plasma sintering (SPS)

Other systems, methods, features and advantages will be, or will become apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments of the disclosure. It is to be understood that both the foregoing general description and the following detailed description of the present disclosure are examples and explanatory and are intended to provide further explanation of the disclosure as claimed.

BRIEF DESCRIPTION OF THE DRAWING

The accompanying drawing, which is included to provide a further understanding of the subject matter and is incorporated in and constitutes a part of this specification, illustrates implementations of the subject matter and together with the description serves to explain the principles of the disclosure.

FIG. 1 is a flow diagram showing the individual process steps of manufacturing a low binder high density cemented carbide for neutron shielding in accordance with an exemplary embodiment of the subject matter.

DETAILED DESCRIPTION

Unless defined otherwise all technical and scientific terms used herein have the same meaning as commonly understood to one of ordinary skill in the art to which the presently described subject matter pertains.

Where a range of values is provided, for example, concentration ranges, percentage ranges, or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

The following definitions set forth the parameters of the described subject matter.

As used herein this disclosure, the term "low binder high density cemented carbide" generally refers to a composite material composed of (I) a ceramic hard phase generally constituted herein of tungsten carbide (WC), sub-stoichiometric ditungsten carbide ($W_2C$), or a mixture thereof, embedded, anchored and cemented by (II) a Fe—Cr based metallic binder matrix (i.e. thus creating a Fe—Cr based metallic binder phase), which Fe—Cr based metallic binder is typically used in a weight from about 0.02 wt. % to about 2.75 wt. % based on the total weight of the cemented carbide. As used herein this disclosure, the term "sub-stoichiometric" refers to a ratio W/C being substantially higher than 1. The ceramic hard phase powder and the Fe—Cr based metallic binder phase powder can be processed into a wide variety of microstructures that achieve different mechanical and physical properties. Moreover, additional components can be added to the composition to help control, and further to refine the properties achieved by cemented carbide compositions. By controlling various parameters, including grain size, Fe—Cr content, dotation (e.g., alloy carbides) and carbon content, a cemented carbide manufacturer can favorably tailor and direct its performance to specific and unique applications. A cemented carbide is ideally designed to provide the physical optimal properties of both a ceramic, such as a high temperature-resistance and a great hardness, and those of a metal, such as the capability to undergo plastic deformation and provide good fracture toughness. The naturally ductile soft Fe—Cr metal binder serves to offset the characteristic brittle behavior of the ceramic hard phase, thus raising and thereby augmenting its associated fracture toughness and durability. The ceramic hard phase of the cemented carbide is generally composed of refractory carbides of metals, such as, but not limited to most typically tungsten, however alternatively titanium, tantalum, chromium, vanadium, zirconium, or any combinations thereof. The ceramic hard phase can be present in the cemented carbide powder in any possible combination having the mentioned metals, and in a weight that is not inconsistent and incompatible with the objectives of the present subject matter. To qualify as a cemented carbide herein this disclosure, a cemented carbide generally has a ceramic hard phase constituted of at least about 97.25 wt. % to about 99.98 wt. % based on the total weight of the cemented carbide.

As used herein this disclosure, "wt. %" refers to a given weight percent (I) based on a total weight of a low binder high density cemented carbide composition for neutron shielding in a nuclear reactor, (II) based on a total weight of a low binder high density cemented carbide for neutron shielding in a nuclear reactor, or (III) based on a total weight of a Fe—Cr based metallic binder phase. When "wt. %" is mentioned in the disclosure or in the claims, it will also explicitly be mentioned, whether it refers to a given weight percent of (I), (II), or (III) in each given particular scenario.

As used herein this disclosure, the term "D50" refers to a particle size corresponding to 50% of the volume of the sampled particles being smaller than and 50% of the volume of the sampled particles being greater than the recited D50 value. Similarly, the term "D90" refers to a particle size corresponding to 90% of the volume of the sampled particles being smaller than and 10% of the volume of the sampled particles being greater than the recited D90 value. The term "D10" refers to a particle size corresponding to 10% of the volume of the sampled particles being smaller than and 90% of the volume of the sampled particles being greater than the recited D10 value. A width of the particle size distribution can be calculated by determining the span, which is defined by the equation (D90−D10)/D50. The span gives an indication of how far the 10 percent and the 90 percent points are apart normalized with the midpoint.

As used herein this disclosure, the term "about" is meant to mean plus or minus 5% of the numerical value of the number with which it is being used in the claims and herein this disclosure. Thus, "about" may be used to provide flexibility to a numerical range endpoint, in which, a given value may be "above" or "below" the given value. As such, for example a value of 50% may be intended to encompass a range, which may be defined by for example ranges like 47.5%-52.25%, 47.5%-52.5%, 47.75%-50%, 50%-52.5%, 48%-48.5%, 48%-48.75%, 48%-49%, 48%-49.5%, 48%-49.75%, 48%-50%, 48%-50.25%, 48%-50.5%, 48%-50.75%, 48%-51%, 48%-51.5%, 48%-51.75%, 48%-52%, 48%-52.25%, 48%-52.5%, 48.25%-48.5%, 48.25%-48.75%, 48.25%-49%, 48.25%-49.5%, 48.25%-49.75%, 48.25%-50%, 48.25%-50.25%, 48.25%-50.5%, 48.25%-50.75%, 48.25%-51%, 48.25%-51.25%, 48.25%-51.5%, 48.25%-51.75%, 48.25%-52%, 48.25%-52.25%, 48.25%-52.5%, 48.5%-48.75%, 48.5%-49%, 48.5%-49.5%, 48.5%-49.75%, 48.5%-50%, 48.5%-50.25%, 48.5%-50.5%, 48.5%-50.75%, 48.5%-51%, 48.5%-51.25%, 48.5%-51.5%, 48.5%-51.75%, 48.5%-52%, 48.5%-52.25%, 48.5%-52.5%, 49%-49.25%, 49%-49.5%, 49%-49.75%, 49%-50%, 49%-50.25%, 49%-50.5%, 49%-50.75%, 49%-51%, 49%-51.25%, 49%-51.5%, 49%-51.75%, 49%-52%, 49%-52.25%, 49%-52.5% 49.5%-49.75%, 49.5%-50%, 49.5%-50.25%, 49.5%-50.5%, 49.5%-50.75%, 49.5%-51%, 49.5%-51.5%, 49.5%-51.75%, 49.5%-52%, 49.5%-52.25%, 49.5%-52.5%, 49.75%-50%, 49.75%-50.25%, 49.75%-50.5%, 49.75%-50.75%, 49.75%-51%, 49.75%-51.25%, 49.75%-51.5%, 49.75%-51.75%, 49.75%-52%, 49.75%-52.25%, 49.75%-52.5%, 50%-50.25%, 50%-50.5%, 50%-50.75%, 50%-51%, 50%-51.25%, 50%-51.5%, 50%-52%, 50%-52.25%, 50%-52.5% etc.

As used herein this disclosure, the term "sintering" refers to a process, where heating under a controlled pressure is conducted to minimize the surface area of a particulate system, which is associated with generation of bonds between neighboring small particles or granules, and subsequent shrinkage of the aggregated particles or granules. Compacting and forming a dense solid bulk mass is performed by heating the particles under a controlled pressure.

As used herein this disclosure, the term "particle" refers to a discrete body or bodies.

Wherever used throughout the disclosure, the term "generally" has the meaning of "typically" or "closely" or "within the vicinity or range of".

As used herein this disclosure, the term "substantially" refers to the complete or nearly complete extent or degree of an action, characteristic, property, state, structure, item, or result.

As used herein, "spherical" refers to the grains having a substantially "round" shape.

As used herein, the term "Palmqvist fracture toughness" i.e. ($K_{Ic}$), refers to the ability of a material with pre-cracks to resist further fracture propagation upon absorbing energy.

As used herein, the term "HV30 Vickers hardness" (i.e. applying a 30 kgf load) is a measure of the resistance of a sample to localized plastic deformation, which is obtained by indenting the sample with a Vickers tip at 30 kgf.

As used herein, the ISO 28079-2009 standard specifies a method for measuring the fracture toughness and the hardness of hardmetals, cermets and cemented carbides at room temperature by an indentation method. The ISO 28079-2009 standard applies to a measurement of the fracture toughness and hardness calculated by using the diagonal lengths of indentations and cracks emanating from the corners of a Vickers hardness indentation, and it is intended for use with metal-bonded carbides and carbonitrides (e.g., hardmetals, cermets or cemented carbides). The test procedures proposed in the ISO 28079-2009 standard are intended for use at ambient temperatures but can be extended to higher or lower temperatures by agreement. The test procedures proposed in the ISO 28079-2009 standard are also intended for use in a normal laboratory-air environment. They are typically not intended for use in corrosive environments, such as strong acids or seawater. The ISO 28079-2009 standard is directly comparable to the standard ASTM B771 as disclosed for example in "Comprehensive Hard Materials book", 2014, Elsevier Ltd. Page 312, which is incorporated herein by reference in its entirety. Thus, it can be assumed that the measured fracture toughness and the hardness using the ISO 28079-2009 standard will be the same as the measured values employing the ASTM B771 standard.

As used herein this disclosure, the term "corrosion" refers to a process that converts a metal into a chemically other form, such as for example an oxide, a hydroxide, a carbonate, or a sulfide. It is the gradual destruction of materials (i.e., usually a metal) by chemical and/or electrochemical reaction with their environment. In the most common use of the word, this means electrochemical oxidation of a metal in a reaction with an oxidant such as for example oxygen or sulfates. Rusting, which is namely the formation of iron oxides, is a well-known example of an electrochemical corrosion process. This type of damage typically produces oxide(s) or salt(s) of the original metal. Corrosion can also occur in materials other than metals, such as for instance ceramics or polymers etc.

As used herein this disclosure, "physical vapor deposition (PVD)" refers to a variety of vacuum deposition methods, which can be used to produce thin films and coatings. PVD is characterized by a process, in which, the material that is deposited goes from a condensed phase to a vapor phase, and then back to a thin film condensed phase. The most common PVD processes are sputtering and evaporation.

As used herein this disclosure, "chemical vapor deposition (CVD)" refers to a method, where the substrate is exposed to one or more volatile precursors, which react and/or decompose on the substrate surface to produce the desired deposit. Frequently, volatile by-products are also produced, which are removed by gas flow through a reaction chamber.

As used herein this disclosure, the term "theoretical density" is defined as the maximum density of a material or element that can be obtained, assuming that there are no voids or contaminants in the material. The formula for calculating the theoretical density is as follows:

$$\rho = (n * A)/(V * N),$$

where $\rho$ is the density ($g/cm^3$)

n is the number of atoms per unit cell

A is the atomic weight (g/mol)

V is the volume per unit cell ($cm^3$/cell)

N is Avogadro's number ($6.023*10^{23}$ $mol^{-1}$).

Low Binder High Density Cemented Carbide Compositions for Neutron Shielding

The current disclosure is based and predicated on the premise of providing high density cemented carbide compositions having a low metallic binder weight from typically about 0.02 wt. % up to about 2.75 wt. % based on the total weight of the cemented carbide composition. A low binder high density cemented carbide composition for neutron shielding in nuclear reactors is presented constituted of a ceramic hard phase and an iron (Fe)-chromium (Cr) based metallic binder phase. The binder phase is uniquely composed of elements displaying an acceptably good short radioactive half-life e.g., about 44 days for the Fe and about 27 days for the Cr, in contrast to cobalt (Co) and nickel (Ni), which have traditionally been used as metallic binders in cemented carbide compositions. Moreover, when Cr is added into the cemented carbide composition, an improved corrosion resistance is established. Thus, the obtained beneficial effects are at least manifold. Environmentally safe cemented carbide compositions are in effect produced for neutron shielding in nuclear reactors exhibiting a low binder and a high density with an improved corrosion resistance, and a short radioactive half-life activity for the components making up the cemented carbide compositions. However, the embodiments disclosed herein are not strictly limited to only neutron shielding in nuclear reactors. Importantly, they may further find a compelling utility and naturally be implemented in connection with other systems, that may routinely require an efficacious neutron shielding and quelling capability. This may encompass for example security scanners, industrial inspection systems, nuclear waste generated from for example defense, research and development (R&D) activities, utility, or medical uses, and other nuclear energy-related applications, which undesirably emit neutrons e.g. nuclear waste recycling, neutron radiography (N-ray) devices employing neutron imaging techniques, for elimination of neutrons scattered by construction elements, neutron generators used for example in oil well logging and security inspection systems etc.

The ceramic hard phase of the cemented carbide composition for neutron shielding herein is most typically composed of tungsten carbide (WC), sub-stoichiometric ditungsten carbide ($W_2C$), or a combination thereof. In some examples, the ceramic hard phase of the cemented carbide composition may alternatively be composed of for example carbides of at least one metal selected from group 4, 5, or 6 of the periodic table, or any combinations thereof. In certain particular embodiments, the ceramic hard phase may alternatively be composed of at least one of carbides of tungsten, titanium, tantalum, vanadium, zirconium, chromium, or any combinations thereof. The ceramic hard phase encompassing the aforementioned metal carbides may incorporate them in any combination that is not inconsistent and incompatible with the objectives of the present subject matter.

The ceramic hard phase may typically be present in a weight from about 97.25 wt. % to about 99.98 wt. % based on the total weight of the cemented carbide composition. In some examples, the ceramic hard phase is present in a weight from about 97.50 wt. % to about 99.98 wt. % based on the total weight of the cemented carbide composition. In other examples, the ceramic hard phase is present in a weight from about 97.75 wt. % to about 99.98 wt. % based on the total weight of the cemented carbide composition. In yet other examples, the ceramic hard phase is present in a weight from about 98.00 wt. % to about 99.98 wt. % based on the total weight of the cemented carbide composition. In still other examples, the ceramic hard phase is present in a weight from about 98.25 wt. % to about 99.98 wt. % based on the total weight of the cemented carbide composition. In further examples, the ceramic hard phase is present in a weight from about 98.50 wt. % to about 99.98 wt. % based on the total weight of the cemented carbide composition. In further other examples, the ceramic hard phase is present in a weight from about 98.75 wt. % to about 99.98 wt. % based on the total weight of the cemented carbide composition. In even other examples, the ceramic hard phase is present in a weight from about 99.00 wt. % to about 99.98 wt. % based on the total weight of the cemented carbide composition. In other embodiments, the ceramic hard phase is present in a weight from about 99.25 wt. % to about 99.98 wt. % based on the total weight of the cemented carbide composition. In even other embodiments, the ceramic hard phase is present in a weight from about 99.50 wt. % to about 99.98 wt. % based on the total weight of the cemented carbide composition. In even further other embodiments, the ceramic hard phase is present in a weight from about 99.75 wt. % to about 99.98 wt. % based on the total weight of the cemented carbide composition.

The ceramic hard phase may also be present in a weight from about 97.25 wt. % to about 97.50 wt. %, from about 97.50 wt. % to about 97.75 wt. %, from about 97.50 wt. % to about 98.00 wt. %, from about 97.25 wt. % to about 97.75 wt. %, from about 97.25 wt. % to about 98.00 wt. %, from about 97.25 wt. % to about 98.25 wt. %, from about 97.25 wt. % to about 98.50 wt. %, from about 97.25 wt. % to about 98.75 wt. %, from about 97.25 wt. % to about 99.00 wt. %, from about 97.75 wt. % to about 98.00 wt. %, from about 98.00 wt. % to about 98.25 wt. %, from about 97.75 wt. % to about 98.25 wt. %, from about 98.25 wt. % to about 98.50 wt. %, from about 98.50 wt. % to about 98.75 wt. %, from about 98.25 wt. % to about 98.75 wt. %, from about 98.75 wt. % to about 99.00 wt. %, from about 99.00 wt. % to about 99.25 wt. %, from about 98.25 wt. % to about 99.25 wt. %, from about 98.75 wt. % to about 99.25 wt. %, from about 98.75 wt. % to about 99.50 wt. %, or from about 98.75 wt. % to about 99.75 wt. % based on the total weight of the cemented carbide composition.

The cemented carbide composition may generally include from about 0.02 wt. % to about 2.75 wt. % of the Fe—Cr based metallic binder phase based on the total weight of the cemented carbide composition. In some examples, the cemented carbide composition includes from about 0.10 wt. % to about 2.75 wt. % of the Fe—Cr based metallic binder phase based on the total weight of the cemented carbide composition. In other examples, the cemented carbide composition includes from about 0.20 wt. % to about 2.75 wt. % of the Fe—Cr based metallic binder phase based on the total weight of the cemented carbide composition. In yet other examples, the cemented carbide composition includes from about 0.25 wt. % to about 2.75 wt. % of the Fe—Cr based metallic binder phase based on the total weight of the cemented carbide composition. In still other examples, the cemented carbide composition includes from about 0.50 wt. % to about 2.75 wt. % of the Fe—Cr based metallic binder phase based on the total weight of the cemented carbide composition. In even other examples, the cemented carbide composition includes from about 0.75 wt. % to about 2.75 wt. % of the Fe—Cr based metallic binder phase based on the total weight of the cemented carbide composition. In other embodiments, the cemented carbide composition includes from about 1.00 wt. % to about 2.75 wt. % of the Fe—Cr based metallic binder phase based on the total weight of the cemented carbide composition. In still other embodiments, the cemented carbide composition includes from about 1.25 wt. % to about 2.75 wt. % of the Fe—Cr based metallic binder phase based on the total weight of the cemented carbide composition. In yet other embodiments, the cemented carbide composition includes from about 1.50 wt. % to about 2.75 wt. % of the Fe—Cr based metallic binder phase based on the total weight of the cemented carbide composition. In even other embodiments, the cemented carbide composition includes from about 1.75 wt. % to about 2.75 wt. % of the Fe—Cr based metallic binder phase based on the total weight of the cemented carbide composition. In further other embodiments, the cemented carbide composition includes from about 2.00 wt. % to about 2.75 wt. % of the Fe—Cr based metallic binder phase based on the total weight of the cemented carbide composition. In even further other embodiments, the cemented carbide composition includes from about 2.25 wt. % to about 2.75 wt. % of the Fe—Cr based metallic binder phase based on the total weight of the cemented carbide composition. In even further other embodiments, the cemented carbide composition includes from about 2.50 wt. % to about 2.75 wt. % of the Fe—Cr based metallic binder phase based on the total weight of the cemented carbide composition.

The Fe—Cr based metallic binder phase may also be present in a weight from about 0.02 wt. % to about 0.10 wt. %, from about 0.10 wt. % to about 0.20 wt. %, from about 0.20 wt. % to about 0.25 wt. %, from about 0.02 wt. % to about 0.20 wt. %, from about 0.02 wt. % to about 0.25 wt. %, from about 0.02 wt. % to about 0.50 wt. %, from about 0.02 wt. % to about 0.75 wt. %, from about 0.25 wt. % to about 0.50 wt. %, from about 0.25 wt. % to about 0.75 wt. %, from about 0.50 wt. % to about 0.75 wt. %, from about 0.75 wt. % to about 1.00 wt. %, from about 1.00 wt. % to about 1.25 wt. %, from about 0.50 wt. % to about 1.00 wt. %, from about 0.50 wt. % to about 1.25 wt. %, from about 0.50 wt. % to about 1.50 wt. %, from about 0.50 wt. % to about 1.75 wt. %, from about 0.50 wt. % to about 2.00 wt. %, from about 0.50 wt. % to about 2.25 wt. %, from about 0.50 wt. % to about 2.50 wt. %, from about 1.25 wt. % to about 1.50 wt. %, from about 1.50 wt. % to about 1.75 wt. %, from about 1.75 wt. % to about 2.00 wt. %, from about 1.25 wt. % to about 2.00 wt. %, from about 1.25 wt. % to about 2.25 wt. %, from about 2.00 wt. % to about 2.25 wt. %, from about 2.25 wt. % to about 2.50 wt. %, or from about 2.00 wt. % to about 2.50 wt. % based on the total weight of the cemented carbide composition.

In certain particular embodiments, the cemented carbide composition may include about 2.75 wt. % of the Fe—Cr based metallic binder phase based metallic binder phase based on the total weight of the cemented carbide composition.

The Cr weight of the metallic binder phase may typically be from about 5 wt. % to about 16 wt. % based on the total weight of the Fe—Cr based metallic binder phase. In some examples, the Cr weight of the metallic binder phase is from about 8 wt. % to about 16 wt. % based on the total weight of the Fe—Cr based metallic binder phase. In other examples, the Cr weight of the metallic binder phase is from about 10 wt. % to about 16 wt. % based on the total weight of the Fe—Cr based metallic binder phase. In yet other examples, the Cr weight of the metallic binder phase is from about 12 wt. % to about 16 wt. % based on the total weight of the Fe—Cr based metallic binder phase. In still other examples, the Cr weight of the metallic binder phase is from about 14 wt. % to about 16 wt. % based on the total weight of the Fe—Cr based metallic binder phase.

The Cr weight of the metallic binder phase may also be present from about 5 wt. % to about 6 wt. %, about 5 wt. % to about 7 wt. %, about 5 wt. % to about 8 wt. %, from about 5 wt. % to about 9 wt. %, from about 5 wt. % to about 10 wt. %, from about 8 wt. % to about 9 wt. %, from about 8 wt. % to about 10 wt. %, from about 8 wt. % to about 11 wt. %, from about 8 wt. % to about 12 wt. %, from about 8 wt. % to about 13 wt. %, from about 10 wt. % to about 12 wt. %, from about 10 wt. % to about 13 wt. %, from about 10 wt. % to about 14 wt. %, from about 10 wt. % to about 15 wt. %, from about 12 wt. % to about 13 wt. %, from about 12 wt. % to about 14 wt. %, or from about 12 wt. % to about 15 wt. % based on the total weight of the Fe—Cr based metallic binder phase.

In certain particular embodiments, the Cr weight of the metallic binder phase is from about 10.5 wt. % to about 16 wt. % based on the total weight of the Fe—Cr based metallic binder phase.

In certain other particular embodiments, the Cr weight of the metallic binder phase is from about 10.5 wt. % to about 10.7 wt. % based on the total weight of the Fe—Cr based metallic binder phase.

Grain growth inhibitors to suppress the WC and the sub-stoichiometric $W_2C$ grain growth during processing typically known to one of ordinary skilled in the art in the likes of vanadium carbide (VC), chromium carbide ($Cr_3C_2$), tantalum carbide (TaC), titanium carbide (TiC) and zirconium carbide (ZrC) may be present in the cemented carbide composition for neutron shielding in any possible combination, and in any weight, that is not inconsistent and incompatible with the objectives of the present subject matter.

The grain growth inhibitors may be present in a weight from about 0.15 wt. % to about 2.00 wt. %, from about 0.25 wt. % to about 2.00 wt. %, from about 0.50 wt. % to about 2.00 wt. %, from about 0.15 wt. % to about 0.50 wt. %, from about 0.75 wt. % to about 2.00 wt. %, from about 1.00 wt. % to about 2.00 wt. %, from about 1.25 wt. % to about 2.00 wt. %, from about 0.50 wt. % to about 1.25 wt. %, from about 0.50 wt. % to about 1.50 wt. %, from about 0.50 wt. % to about 1.75 wt. %, from about 0.75 wt. % to about 1.25 wt. %, from about 1.00 wt. % to about 1.25 wt. %, from about 1.00 wt. % to about 1.50 wt. %, from about 1.25 wt. % to about 1.50 wt. %, from about 1.25 wt. % to about 1.75 wt. %, from about 1.25 wt. % to about 2.00 wt. %, from about 1.50 wt. % to about 2.00 wt. %, or from about 1.75 wt. % to about 2.00 wt. % based on the total weight of the cemented carbide composition.

The ceramic hard phase powder and the Fe—Cr based metallic binder phase powder described herein this disclosure may have any average particle size that is not incompatible with the objectives of the present disclosure. The ceramic hard phase powder and the Fe—Cr based metallic binder phase powder may generally exhibit an average particle size ranging for example from about 0.5 μm to about 30 μm. In some examples, the ceramic hard phase powder and the Fe—Cr based metallic binder phase powder have an average particle size in a range from about 1 μm to about 5 μm. In other examples, the ceramic hard phase powder and the Fe—Cr based metallic binder phase powder have an average particle size in a range from about 1 μm to about 10 μm. In still other examples, the ceramic hard phase powder and the Fe—Cr based metallic binder phase powder have an average particle size in a range from about 1 μm to about 15 μm. In yet other examples, the ceramic hard phase powder and the Fe—Cr based metallic binder phase powder have an average particle size in a range from about 1 μm to about 20 μm. In further examples, the ceramic hard phase powder and the Fe—Cr based metallic binder phase powder have an average particle size in a range from about 1 μm to about 25 μm. In further other examples, the ceramic hard phase powder and the Fe—Cr based metallic binder phase powder have an average particle size in the range from about 1 μm to about 30 μm.

The ceramic hard phase powder and the Fe—Cr based metallic binder phase powder may also have an average particle size in a range from about 5 μm to about 10 μm, from about 10 μm to about 15 μm, from about 5 μm to about 15 μm, from about 15 μm to about 20 μm, from about 5 μm to about 20 μm, from about 20 μm to about 25 μm, from about 5 μm to about 25 μm, from about 25 μm to about 30 μm, or from about 5 μm to about 30 μm.

For determining a particle size, one having ordinary skill in the art may typically employ either dynamic digital image analysis (DIA), static laser light scattering (SLS) also known as laser diffraction, or by visual measurement by electron microscopy, a technique known as image analysis and light obscuration. Each method covers a characteristic size range within which measurement is possible. These ranges partly overlap. However, the results for measuring the same sample may vary all depending on the particular method that is used. A skilled artisan who wants to determine particle sizes or particle size distributions would readily know how each mentioned method is commonly performed and practiced. Thus, the reader is directed to for example, (i) "Comparison of Methods. Dynamic Digital Image Analysis, Laser Diffraction, Sieve Analysis", Retsch Technology and (ii) the scientific publication by Kelly et al., "Graphical comparison of image analysis and laser diffraction particle size analysis data obtained from the measurements of nonspherical particle systems", AAPS PharmSciTech. 2006 Aug. 18; Vol. 7(3):69, to further gain insight into each procedure and methodology, all of which are incorporated herein by reference in their entirety.

The cemented carbide compositions for neutron shielding described herein may typically display HV30 Vickers hardness values ranging from about 2227 HV30 to about 2700 HV30. In some examples, HV30 Vickers hardness values range from about 2250 HV30 to about 2700 HV30. In other examples, HV30 Vickers hardness values range from about 2275 HV30 to about 2700 HV30. In yet other examples, HV30 Vickers hardness values range from about 2300 HV30 to about 2700 HV30. In still other examples, HV30 Vickers hardness values range from about 2325 HV30 to about 2700 HV30. In further other examples, HV30 Vickers hardness values range from about 2350 HV30 to about 2700 HV30. In other embodiments, HV30 Vickers hardness values range from about 2375 HV30 to about 2700 HV30. In still other embodiments, HV30 Vickers hardness values range from about 2400 HV30 to about 2700 HV30. In yet other embodiments, HV30 Vickers hardness values range from about 2425 HV30 to about 2700 HV30. In even other embodiments, HV30 Vickers hardness values range from about 2450 HV30 to about 2700 HV30. In further other embodiments, HV30 Vickers hardness values range from about 2475 HV30 to about 2700 HV30. In even further other embodiments, HV30 Vickers hardness values range from about 2500 HV30 to about 2700 HV30.

The HV30 Vickers hardness values may also range from about 2227 HV30 to about 2250 HV30, from about, 2250 HV30 to about 2275 HV30, from about 2275 HV30 to about 2300 HV30, from about 2227 HV30 to about 2300 HV30, from about 2300 HV30 to about 2325 HV30, from about 2325 HV30 to about 2350 HV30, from about 2350 HV30 to about 2375 HV30, from about 2375 HV30 to about 2400 HV30, from about 2400 HV30 to about 2425 HV30, from about 2400 HV30 to about 2450 HV30, from about 2400 HV30 to about 2475 HV30, from about 2400 HV30 to about 2500 HV30, from about 2227 HV30 to about 2325 HV30, from about 2227 HV30 to about 2350 HV30, from about 2227 HV30 to about 2375 HV30, from about 2227 HV30 to about 2400 HV30, from about 2227 HV30 to about 2425 HV30, from about 2227 HV30 to about 2450 HV30, from about 2227 HV30 to about 2475 HV30, from about 2227 HV30 to about 2500 HV30, from about 2250 HV30 to about 2325 HV30, from about 2250 HV30 to about 2350 HV30, from about 2250 HV30 to about 2375 HV30, from about 2250 HV30 to about 2400 HV30, from about 2250 HV30 to about 2425 HV30, from about 2250 HV30 to about 2450 HV30, from about 2250 HV30 to about 2475 HV30, from about 2250 HV30 to about 2500 HV30, from about 2275 HV30 to about 2325 HV30, from about 2275 HV30 to about 2350 HV30, from about 2275 HV30 to about 2375 HV30, from about 2275 HV30 to about 2400 HV30, from about 2275 HV30 to about 2425 HV30, from about 2275 HV30 to about 2450 HV30, from about 2275 HV30 to about 2475 HV30, from about 2275 HV30 to about 2500 HV30, from about 2300 HV30 to about 2350 HV30, from about 2300 HV30 to about 2375 HV30, from about 2300 HV30 to about 2400 HV30, from about 2300 HV30 to about 2425 HV30, from about 2300 HV30 to about 2450 HV30, from about 2300 HV30 to about 2475 HV30, from about 2300 HV30 to about 2500 HV30, from about 2325 HV30 to about 2375 HV30, from about 2325 HV30 to about 2400 HV30, from about 2325 HV30 to about 2425 HV30, from about 2325 HV30 to about 2450 HV30, from about 2325 HV30 to about 2475 HV30, from about 2325 HV30 to about 2500 HV30, from about 2350 HV30 to about 2400 HV30, from about 2350 HV30 to about 2425 HV30, from about 2350 HV30 to about 2450 HV30, from about 2350 HV30 to about 2475 HV30, or from about 2350 HV30 to about 2500 HV30, from about 2375 HV30 to about 2425 HV30, from about 2375 HV30 to about 2450 HV30, from about 2375 HV30 to about 2475 HV30, or from about 2375 HV30 to about 2500 HV30.

The cemented carbide compositions for neutron shielding described herein may practically exhibit Palmqvist fracture toughness ($K_{Ic}$) values spanning from about 5 MPa√m to about 7.6 MPa√m. In some examples, Palmqvist fracture toughness ($K_{Ic}$) values span from about 6 MPa√m to about 7.6 MPa√m. In other examples, Palmqvist fracture toughness ($K_{Ic}$) values span from about 7 MPa√m to about 7.6 MPa√m.

The Palmqvist fracture toughness ($K_{Ic}$) values may also span from about 5 MPa√m to about 6 MPa√m, from about 5 MPa√m to about 7 MPa√m, or from about 6 MPa√m to about 7 MPa√m.

Methods of Manufacturing Sintered Low Binder High Density Cemented Carbides for Neutron Shielding A desired particle size of the cemented carbide composition can be produced by subjecting the ceramic hard phase powder and the Fe—Cr based metallic binder phase powder to a milling operation for several hours (e.g., 8, 16, 32, 64 hours) under ambient conditions (i.e., 25° C., 298.15 K and a pressure of 101.325 kPa in a ball mill, an attritor mill, or a planetary mill) to form a powder blend. In some embodiments, instead of using a ball, an attritor mill, or a planetary mill as the physical blending apparatus, ultrasonic mixing may instead suitably be the choice of the blending method. Thus, in this case, ultrasonic mixing uses sound energy to effectively process for example powders, pastes, liquids, and combinations thereof with a breakthrough speed, quality and repeatability. Powders of nearly any size, material characteristic, or morphology are rapidly and thoroughly mixed using for example an acoustic mixer. Acoustic processing is frequently orders of magnitude faster than traditional technologies. Here, the acoustic mixer may for example employ a 60 Hz motion, which then causes each particle to randomly collide with adjacent particles, diverting their paths, colliding and then re-colliding with other particles behaving in equally chaotic fashion. The main purpose of the milling operation is to facilitate a good Fe—Cr based metallic binder phase powder distribution and an advantageous wettability between the powder constituents. Subjecting the powders to the milling operation is imperative to strengthening the physical integrity of the milled ceramic hard phase powder and the Fe—Cr based metallic binder phase powder, and in some cases, to deagglomerate tungsten carbide (WC), or ditungsten carbide ($W_2C$) crystals, or crystals formed by the combinations thereof. An acceptable Fe—Cr based metallic binder phase powder distribution and a good quality of the wettability between the powder components are fundamental parameters for obtaining cemented carbides of stellar physical quality for neutron shielding. On the other hand, if the Fe—Cr based metallic binder phase powder distribution and wettability are of a rather bad quality, pores and cracks may undesirably emerge as a result of this in the final sintered body, which is detrimental to the produced cemented carbide for neutron shielding. In some instances, the ceramic hard phase powder and the Fe—Cr based metallic binder powder can be crushed, or otherwise comminuted prior to the milling operation.

As would be apparent to a skilled artisan, the milling is made by first adding a milling liquid to the powder to form a milling powder slurry composition. The milling liquid may be water, an alcohol such as but not limited to ethanol, methanol, isopropanol, butanol, cyclohexanol, an organic solvent in the likes of for example acetone or toluene, an alcohol mixture, an alcohol and a solvent mixture, or like constituents. The properties of the milling powder slurry composition are dependent on, among other things, the amount of the milling liquid that is added. Because the drying of the milling powder slurry composition requires substantial amount of energy, the amount of the used milling liquid should be minimized to keep costs down. However, enough milling liquid needs to be added to achieve an easily pumpable milling powder slurry composition and avoid clogging of the system. Moreover, other compounds commonly known in the art to a skilled artisan can be added to the slurry e.g., dispersion agents, pH-adjusters, etc. Non-limiting example of organic binder(s), such as e.g., polyethylene glycol (PEG), paraffin, polyvinyl alcohol (PVA), long chain fatty acids, wax, or any combinations thereof, or like components may be added to the milling powder slurry composition prior to the milling typically from for example 15 vol. % and 25 vol. % (i.e., total volume % made up by each mentioned component) of the total volume of the formed slurry. This is essentially done to facilitate the formation of a ceramic hard phase and Fe—Cr based metallic binder phase powder blend during the milling operation.

The milled powder slurry composition can next be spray-dried, freeze-dried, or vacuum-dried and granulated to provide free-flowing powder aggregates typically displaying a spherical shape. As used herein this disclosure, the term "free-flowing" refers to loosely packed cemented carbide powders exhibiting a pore space between each free-flowing particle of the cemented carbide powder with no physical restrictions, or barriers created whatsoever, suppressing the free-flowing capacity of the particles of the cemented carbide powder.

In the case of spray-drying, the milling powder slurry composition composed of the ceramic hard phase powder and the Fe—Cr based metallic binder phase powder mixed with the organic liquid, and the organic binder(s) may be atomized through an appropriate nozzle in a drying tower, where the small discrete droplets are instantaneously dried by a horizontal inflow of a stream of hot gas into the drying tower, for instance in a stream of nitrogen, argon, or air to form spherical powder agglomerates with free-flowing properties. As used herein, "atomization" refers to a process, where a bulk liquid feed is converted into discrete droplets, thereby significantly increasing the surface area of the feed liquid, and thus increasing considerably the achievable rates of evaporation of a given solvent (i.e., milling liquid). The atomization stage is designed to create optimum conditions for evaporation of the given solvent from the milling powder slurry composition. Nozzles and rotary atomizers are used to form sprays. Drying towers may be equipped with just one nozzle, or alternatively with a plurality of such nozzles to form the spherical ceramic hard phase powder and Fe—Cr based metallic binder phase powder blend agglomerates with free-flowing properties.

The dried cemented carbide powder may be subjected to a pre-sintering temperature elevation procedure, to completely remove the organic binder(s), which is also called depegging or dewaxing of the organic binder(s). Suitable temperatures for the complete removal of the organic binder(s) may be employed starting from 200° C. and ending at 450° C., starting from 200° C. and ending at 500° C., starting from 200° C. and ending at 550° C., starting from 200° C. and ending at 600° C., starting from 250° C. and ending at 450° C., starting from 250° C. and ending at 500° C., starting from 250° C. and ending at 550° C., starting from 250° C. and ending at 600° C., starting from 300° C. and ending at 450° C., starting from 300° C. and ending at 500° C., starting from 300° C. and ending at 550° C., or starting from 300° C. and ending at 600° C. This may typically be performed in a reactive $H_2$ atmosphere with a hydrogen ($H_2$) flow rate applied at about 1000 liters/hour to about 10000 liters/hour, applied at about 3000 liters/hour to about 10000 liters/hour, applied at about 6000 liters/hour to about 10000 liters/hour, or applied at about 9000 liters/hour to about 10000 liters/hour. The temperature may customarily be increased constantly at a rate of for example about 0.70° C./min. In some examples, after the organic binder(s) removal, the temperature may be increased in tandem sequentially at a rate of about 2° C./min. shifted to about 10° C./min. when a certain temperature range has been reached, or for example at a rate of about 2° C./min. changed to about 5° C./min. again when a particular temperature range has been reached. The aforementioned temperature ranges for the depegging or dewaxing (i.e., debinding of the organic binder) may generally be reached after heating for about 60 minutes to about 90 minutes, or for about 60 minutes to about 7 hours in the sintering furnace. Thus, in general, the particular type of heating-pattern chosen is determined and performed, and for the particular amount of time, in a manner, that confers and thereby imparts a desired complete dewaxed phase-transformation of the cemented carbide powder. In general, the pre-sintering cycle for dewaxing of the organic binder(s) may be conducted in a reactive ($H_2$) atmosphere, in vacuum, or in a non-reactive inert atmosphere e.g., nitrogen ($N_2$) or argon (Ar).

Next, the cemented carbide powder subsequently undergoes a consolidation process to ultimately form the high density cemented carbide for neutron shielding. As used herein this disclosure, the term "consolidation process" is meant to include any process that (i) compacts (i.e., presses) and (ii) consolidates (i.e., densifies, thus sinters the material by heating) the cemented carbide powder simultaneously. In some examples, the consolidation process may be done by hot pressing (HP) the cemented carbide powder. HP is a relatively slow process and compacting is usually uniaxial. Heating is done at the same time by elements that are integrated in the press. In other examples, the consolidation process may be performed by hot isostatic pressing (HIP). HIP is similarly a relatively slow process as well and compacting is isostatic, i.e., pressure is applied in 3 directions or axis. Heating is performed at the same time by elements that are integrated in the press. Thus, HIP subjects the cemented carbide powder to both an elevated temperature and isostatic gas pressure in, for example, a high pressure containment vessel. The pressurizing gas that is used may, for example, be argon. An inert gas such as argon is most typically used, so that the material undergoing HIP, does not chemically react. The chamber is heated, causing the pressure inside the vessel to increase. The pressure is applied to the cemented carbide powder from all 3 directions. The inert argon gas may be applied typically from about 7,350 psi (about 50.7 MPa) to about 45,000 psi (about 310 MPa), with about 15,000 psi (about 100 MPa) typically being the most used pressure. In yet other examples, the consolidation process may be performed by spark plasma sintering (SPS). The main characteristics of SPS is that a pulsed direct current (DC) or an alternating current (AC) current passes through a sintering mould. The heat generation is internal, in contrast to HP and HIP, where the heat is provided by external heating elements. This facilitates high heating and cooling rates (e.g., up to 1000 K/min). Thus, the sintering process is generally fast, typically completed within a few minutes. The speed of the process ensures that it has the potential of densifying cemented carbide powders with nanosize or nanostructure, while avoiding coarsening, which accompanies standard densification techniques. Compacting is typically uniaxial in SPS, although in terms of stress state, one can potentially reach an isostatic stress state, because of the effect imparted by the rigid sintering mould that contains and encases the cemented carbide powder. As mentioned above, heating is supplied by subjecting the sintering mould to an electrical current field that passes through the sintering mould containing the cemented carbide powder. SPS may be used as a tool for forming functionally graded soft-magnetic cemented carbide powders, and it is useful in accelerating the development of magnetic materials. Of note, SPS improves the oxidation-resistance as well as the wear-resistance of sintered cemented carbide, in comparison to more conventional consolidation methods. In still other examples, similar methodologies of such previously mentioned technologies may equally well be adopted for the consolidation process of the cemented carbide powder, which would be apparent to one having ordinary skill in the art.

The applied temperature for the previously mentioned sintering consolidation processes may principally be in a range starting from 1300° C. and ending at 1500° C., starting from 1300° C. and ending at 1600° C., starting from 1300° C. and ending at 1700° C., starting from 1300° C. and ending at 1800° C., starting from 1400° C. and ending at 1500° C., starting from 1400° C. and ending at 1600° C., starting from 1400° C. and ending at 1700° C., starting from 1400° C. and ending at 1800° C., starting from 1500° C. and ending at 1600° C., starting from 1500° C. and ending at 1700° C., or starting from 1500° C. and ending at 1800° C.

In the case for HIP, HIP can be performed on the cemented carbide powder, or alternatively, as an extra step performed on the sintered cemented carbide. In this case, cemented carbide material will be pressed, and will typically be vacuum sintered in generally a non-reactive inert atmosphere e.g., argon (Ar), or nitrogen ($N_2$). Next, the sintered cemented carbide may undergo an additional HIP-treatment step. This additional HIP-step fulfils the purpose of eliminating any porosity that may be present in the sintered cemented carbide powder. During vacuum-sintering, the applied temperature may, for example, range starting from 1300° C. and ending at 1500° C., starting from 1300° C. and ending at 1600° C., starting from 1300° C. and ending at 1700° C., starting from 1300° C. and ending at 1800° C., starting from 1300° C. and ending at 1900° C., starting from 1300° C. and ending at 2000° C., starting from 1400° C. and ending at 1500° C., starting from 1400° C. and ending at 1600° C., starting from 1400° C. and ending at 1700° C., starting from 1400° C. and ending at 1800° C., starting from 1400° C. and ending at 1900° C., starting from 1400° C. and ending at 2000° C., starting from 1500° C. and ending at 1600° C., starting from 1500° C. and ending at 1700° C., starting from 1500° C. and ending at 1800° C., starting from 1500° C. and ending at 1900° C., or starting from 1500° C. and ending at 2000° C.

Turning now to FIG. 1, this FIGURE depicts a flow diagram demonstrating the individual process steps of fabricating a low binder high density cemented carbide for neutron shielding in accordance with an exemplary embodiment of the subject matter. FIG. 1 shows that in step 100, the process is initiated by blending a powder mixture in a milling liquid including powders forming hard constituents of a ceramic hard phase and an iron (Fe)-chromium (Cr) based metallic binder phase including chromium from about 5 wt. % to about 16 wt. % based on a total weight of the Fe—Cr based metallic binder phase, with an organic binder to form a slurry blend. Next in step 102, the formed slurry blend is dried by any one of the described methodologies to obtain a powder blend. In step 105, a pre-sintering temperature elevation procedure is executed, which in turn, completely removes any potentially remaining organic binder, and thereby dewaxes and depegs the formed powder blend. The process is finally concluded in step 110, where the dewaxed powder blend is sintered by performing any one of the consolidation methodologies, which may include hot pressing (HP), hot isostatic pressing (HIP), or spark plasma sintering (SPS), to ultimately form the sintered high density cemented carbide utilized for neutron shielding. It should however be understood, that sintering generally includes processes defined by depegging, solid state sintering, liquid phase sintering, and ultimately cooling the sintered material down to ambient conditions after the sintering operation is fully complete. A person having ordinary skill in the art would know that the aforementioned steps in the consolidation processes can be performed all at once in the same consolidation equipment. Alternatively, a person having ordinary skill in the art would also know that they may equally be performed one straight after the other in different consolidation equipments.

The cemented carbide composition for neutron shielding as set forth herein may have a theoretical density in a range from typically about 15.25 g/cm$^3$ to about 17 g/cm$^3$. In some examples, the cemented carbide composition has a theoretical density in a range from about 15.50 g/cm$^3$ to about 17 g/cm$^3$. In other examples, the cemented carbide composition has a theoretical density in a range from about 15.75 g/cm$^3$ to about 17 g/cm$^3$. In yet other examples, the cemented carbide composition has a theoretical density in a range from about 16 g/cm$^3$ to about 17 g/cm$^3$. In still other examples, the cemented carbide composition has a theoretical density in a range from about 16.25 g/cm$^3$ to about 17 g/cm$^3$. In further other examples, the cemented carbide composition has a theoretical density in a range from about 16.50 g/cm$^3$ to about 17 g/cm$^3$. In even other examples, the cemented carbide composition has a theoretical density in a range from about 16.75 g/cm$^3$ to about 17 g/cm$^3$.

The cemented carbide composition may also have a theoretical density in a range from about 15.25 g/cm$^3$ to about 15.50 g/cm$^3$, from about 15.50 g/cm$^3$ to about 15.75 g/cm$^3$, from about 15.75 g/cm$^3$ to about 16 g/cm$^3$, from about 15.25 g/cm$^3$ to about 15.75 g/cm$^3$, from about 15.25 g/cm$^3$ to about 16 g/cm$^3$, from about 15.25 g/cm$^3$ to about 16.25 g/cm$^3$, from about 16 g/cm$^3$ to about 16.25 g/cm$^3$, from about 16 g/cm$^3$ to about 16.50 g/cm$^3$, from about 16 g/cm$^3$ to about 16.75 g/cm$^3$, from about 16.25 g/cm$^3$ to about 16.50 g/cm$^3$, from about 16.25 g/cm$^3$ to about 16.75 g/cm$^3$, or from about 16.50 g/cm$^3$ to about 16.75 g/cm$^3$.

The following TABLE 1 depicts the theoretical density in certain particular embodiments of the cemented carbide compositions A-E of the present application in comparison to a comparative sample F. TABLE 1 shows that when the metallic binder phase has a weight that is about 9% higher than 2.75 wt. % based on the total weight of the cemented carbide composition (i.e. 3 wt. % in the comparative sample H versus 2.75 wt. % in the application sample G), it is seen that the theoretical density decreases from 15.21 g/cm$^3$ to 15.17 g/cm$^3$, which would then have a weakening and detrimental effect on the neutron shielding potential of comparative sample H. In other words, this means that a cemented carbide sample with a low density will need to have a higher thickness, in comparison to a cemented carbide sample with a high density to obtain the same neutron shielding effect and capability.

TABLE 1

| Sample | WC (wt. %) | $W_2C$ (wt. %) | Cr (wt. %) | Fe (wt. %) | Cr in binder (wt. %) | Binder (wt. %) | Total weight (wt. %) | Theoretical density (g/cm$^3$) |
|---|---|---|---|---|---|---|---|---|
| A | 0 | 99.98 | 0.0022 | 0.0178 | 11.00 | 0.02 | 100 | 17.10 |
| B | 99.98 | 0 | 0.0022 | 0.0178 | 11.00 | 0.02 | 100 | 15.62 |
| C | 0 | 99.50 | 0.05 | 0.45 | 10.00 | 0.50 | 100 | 16.99 |
| D | 49.75 | 49.75 | 0.05 | 0.45 | 10.00 | 0.50 | 100 | 16.24 |
| E | 99.50 | 0 | 0.05 | 0.45 | 10.00 | 0.50 | 100 | 15.55 |
| F | 98.50 | 0 | 0.16 | 1.34 | 10.67 | 1.50 | 100 | 15.40 |
| G | 97.25 | 0 | 0.29 | 2.46 | 10.55 | 2.75 | 100 | 15.21 |
| H-comparative | 97.00 | 0 | 0.32 | 2.68 | 10.67 | 3.00 | 100 | 15.17 |

EXAMPLES

The following examples are put forth so as to provide those of ordinary skill in the art with a complete disclosure and description of how to make and use the described subject matter and are not intended to limit the scope of what the inventors regard as their disclosure nor are they intended to represent that the experiments below are all or the only experiments performed. Efforts have been made to ensure accuracy with respect to numbers used but some experimental errors and deviations should be accounted for.

Example 1

High Density Cemented Carbide Compositions with a Ceramic Hard Phase and a Low Weight Iron (Fe)-Chromium (Cr) Based Metallic Binder Phase Exhibit a Superior Corrosion Resistance in Comparison to a Comparative Sample

TABLE 2

| Sample | WC (wt. %) | Cr (wt. %) | Fe (wt. %) | Cr in binder (wt. %) | Binder (wt. %) | Total weight (wt. %) | Effects of the Passive Layer on the Metallic Binder Surface |
|---|---|---|---|---|---|---|---|
| C | 97.25 | 0.29 | 2.46 | 10.5 | 2.75 | 100.0 | Good continuity of the passive layer ($Cr_3O_2$) on the metallic binder surface |
| D-comparative | 97.00 | 0.32 | 2.68 | 10.7 | 3.00 | 100.0 | Good continuity of the passive layer $Cr_3O_2$ on the metallic binder surface |
| E-comparative | 97.00 | 0.24 | 2.66 | 8.3 | 2.90 | 99.9 | Lower continuity of the passive layer $Cr_3O_2$ on the metallic binder surface |
| F-comparative | 97.00 | 0.06 | 2.94 | 2.0 | 3.00 | 100.0 | Poor continuity of the passive layer $Cr_3O_2$ on the metallic binder surface |

TABLE 2 demonstrates that when the used metallic binder phase weight gets close to 3 wt. % (i.e., comparative samples E-F) based on the total weight of the cemented carbide composition, (I) a lower continuity and (II) a poor continuity of the passive layer $Cr_3O_2$ on the metallic binder surface is demonstrated for comparative sample E and comparative sample F respectively. Thus, in this instance, comparative sample E and comparative sample F will potentially exhibit a lower corrosion resistance due to lessened positive effects in terms of the continuity of the passive layer $Cr_3O_2$ imparted on the metallic binder surface. While comparative sample D demonstrates a good continuity of the passive layer ($Cr_3O_2$) on the metallic binder surface despite exhibiting a metallic binder phase weight of 3 wt. %, this is favorably attributed to the Cr content being in a weight of about 10.7 wt. % based on the total weight of the Fe—Cr based metallic binder phase.

Example 2

High Density Cemented Carbide Compositions with a Ceramic Hard Phase and a Low Weight Iron (Fe)-Chromium (Cr) Based Metallic Binder Phase Exhibit a Robust Hardness and Fracture Toughness

TABLE 3

| Sample | $W_2C$ (wt. %) | WC (wt. %) | Cr (wt. %) | Fe (wt. %) | Cr in binder (wt. %) | Binder (wt. %) | Total weight (wt. %) | HV30 | $K_{Ic}$ (MPa √m) | Density (g/cm$^3$) | Theoretical density (g/cm$^3$) |
|---|---|---|---|---|---|---|---|---|---|---|---|
| $W_2C$_Fe | 99.98 | 0 | 0.0022 | 0.0178 | 11.0 | 0.02 | 100 | 2700 | 5 | 17.03 | 17.10 |
| WC_Fe1 | 0 | 99.98 | 0.0022 | 0.0178 | 11.0 | 0.02 | 100 | 2700 | 5 | 15.55 | 15.62 |
| WC_Fe2 | 0 | 99.50 | 0.050 | 0.450 | 10.0 | 0.50 | 100 | 2416 | 7.6 | 15.48 | 15.55 |
| WC_Fe3 | 0 | 98.50 | 0.160 | 1.340 | 10.7 | 1.50 | 100 | 2421 | 7.6 | 15.31 | 15.40 |
| WC_Fe4 | 0 | 97.25 | 0.290 | 2.460 | 10.5 | 2.75 | 100 | 2227 | 7.1 | 15.18 | 15.21 |
| WC_Fe5 | 0 | 98.00 | 0.105 | 1.895 | 5.3 | 2.00 | 100 | 2302 | 7.3 | 15.28 | 15.33 |
| WC_Fe6 | 0 | 98.00 | 0.320 | 1.680 | 16.0 | 2.00 | 100 | 2445 | 7.5 | 15.26 | 15.32 |

TABLE 3 depicts compositions for samples $W_2C$_Fe, WC_Fe1, WC_Fe2, WC_Fe3, WC_Fe4, WC_Fe5 and WC_Fe6, which include a Fe—Cr based metallic binder having a weight ranging from 0.02 wt. % to 2.75 wt. %, WC having a weight spanning from 97.25 wt. % to 99.98 wt. %, and $W_2C$ having a weight of 99.98 wt. %.

HV30 Vickers hardness and Palmqvist fracture toughness ($K_{Ic}$) measurements were determined in accordance with ISO 28079:2009 for cemented carbides. Three indentations per material were performed at 30 kgf using a Vickers Limited equipment. The indent diagonals and the crack lengths emerging from the indentation corners were measured with a light optical microscope at a magnification of 500×.

As demonstrated in TABLE 3, the obtained HV30 Vickers hardness values for the samples $W_2C$_Fe, WC_Fe1, WC_Fe2, WC_Fe3, WC_Fe4, WC_Fe5 and WC_Fe6 range from 2227 HV30 to 2700 HV30. On the other hand, the obtained Palmqvist fracture toughness ($K_{Ic}$) values span from 5 MPa√m to 7.6 MPa√m.

Although the present disclosure has been described in connection with embodiments thereof, it will be appreciated by those skilled in the art that additions, deletions, modifications, and substitutions not specifically described may be made without departure from the spirit and scope of the disclosure as defined in the appended claims.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configured by," "configurable to," "operable/operative to," "adapted/adaptable," "able to," "conformable/conformed to," etc. Those skilled in the art will recognize that such terms (e.g., "configured to") can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The illustrative embodiments described in the detailed description, drawings, and claims are not meant to be limiting. Other embodiments may be utilized, and other changes may be made, without departing from the spirit or scope of the subject matter presented here.

Where a range of values is provided, it is understood that each intervening value, to the tenth of the unit of the lower limit unless the context clearly dictates otherwise, between the upper and lower limit of that range and any other stated or intervening value in that stated range is encompassed within the disclosure. The upper and lower limits of these smaller ranges which can independently be included in the smaller ranges is also encompassed within the disclosure, subject to any specifically excluded limit in the stated range. Where the stated range includes one or both of the limits, ranges excluding both of those included limits are also included in the disclosure.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken as limiting.

Additionally, for example any sequence(s) and/or temporal order of sequence of the system and method that are described herein this disclosure are illustrative and should not be interpreted as being restrictive in nature. Accordingly, it should be understood that the process steps may be shown and described as being in a sequence or temporal order, but they are not necessarily limited to being carried out in any particular sequence or order. For example, the steps in such processes or methods generally may be carried out in various different sequences and orders, while still falling within the scope of the present disclosure.

Finally, the discussed application publications and/or patents herein are provided solely for their disclosure prior to the filing date of the described disclosure. Nothing herein should be construed as an admission that the described disclosure is not entitled to antedate such publication by virtue of prior disclosure.

What is claimed is:

1. A cemented carbide composition, comprising:

a ceramic hard phase; and an iron (Fe)-chromium (Cr) based metallic binder phase present in an amount of from 0.02 wt. % to 2.75 wt. % based on a total weight of the cemented carbide composition, the iron (Fe)-chromium (Cr) based metallic binder phase comprising chromium present in an amount of from 10.5 wt. % to 16 wt. % based on a total weight of the Fe—Cr based metallic binder phase.

2. The cemented carbide composition of claim 1, wherein the chromium is present in an amount of from 10.5 wt. % to 10.7 wt. % based on a total weight of the Fe—Cr based metallic binder phase.

3. The cemented carbide composition of claim 1, wherein the Fe—Cr based metallic binder phase is present in an amount of 2.75 wt. % based on a total weight of the cemented carbide composition.

4. The cemented carbide composition of claim 1, wherein the ceramic hard phase comprises tungsten carbide (WC), sub-stoichiometric ditungsten carbide ($W_2C$), or a combination thereof.

5. The cemented carbide composition of claim 1, wherein the ceramic hard phase comprises tungsten carbide (WC).

6. The cemented carbide composition of claim 1, wherein the ceramic hard phase comprises sub-stoichiometric $W_2C$.

7. The cemented carbide composition of claim 1, wherein the ceramic hard phase comprises a combination of WC and sub-stoichiometric $W_2C$ in a weight ratio of 1:1.

8. The cemented carbide composition of claim 1, wherein the ceramic hard phase is present in an amount of from 97.25 wt. % to 99.98 wt. % based on a total weight of the cemented carbide composition.

9. The cemented carbide composition of claim 1, wherein the cemented carbide composition has a theoretical density of from 15.25 g/cm$^3$ to 17 g/cm$^3$.

10. The cemented carbide composition of claim 1, wherein a cemented carbide composition with improved corrosion resistance is obtained.

11. The cemented carbide of claim 1, wherein the Fe—Cr based metallic binder phase is made by blending a FeCr powder with a $Cr_3C_2$ powder.

12. The cemented carbide composition of claim 1, wherein the cemented carbide composition has an HV30 Vickers hardness in a range of from 2227 HV30 to 2700 HV30 and a Palmqvist fracture toughness ($K_{Ic}$) in a range of from 5 MPa√m to 7.6 MPa√m.

13. A method of manufacturing a sintered cemented carbide, comprising:

blending a powder mixture in a milling liquid comprising powders forming a ceramic hard phase and an iron (Fe)-chromium (Cr) based metallic binder phase, the iron (Fe)-chromium (Cr) based metallic binder phase comprising chromium present in an amount of from 10.5 wt. % to 16 wt. % based on a total weight of the Fe—Cr based metallic binder phase, with an organic binder to form a slurry blend;

drying the slurry blend to form a powder blend; and sintering the powder blend to form the sintered high density cemented carbide, wherein the Fe—Cr based metallic binder phase is present in an amount of from 0.02 wt. % to 2.75 wt. % based on a total weight of the sintered cemented carbide.

14. The method of manufacturing a sintered cemented carbide of claim 13, wherein the chromium is present in an amount of from 10.5 wt. % to 10.7 wt. % based on a total weight of the Fe—Cr based metallic binder phase.

15. The method of manufacturing a sintered cemented carbide of claim 13, wherein the Fe—Cr based metallic binder phase is present in an amount of 2.75 wt. % based on a total weight of the sintered cemented carbide.

16. The method of manufacturing a sintered cemented carbide of claim 13, wherein the ceramic hard phase comprises tungsten carbide (WC), sub-stoichiometric ditungsten carbide ($W_2C$), or a combination thereof.

17. The method of manufacturing a sintered cemented carbide of claim 13, wherein the ceramic hard phase comprises tungsten carbide (WC).

18. The method of manufacturing a sintered cemented carbide of claim 13, wherein the ceramic hard phase comprises sub-stoichiometric $W_2C$.

19. The method of manufacturing a sintered cemented carbide of claim 13, wherein the ceramic hard phase comprises a combination of WC and sub-stoichiometric $W_2C$ in a weight ratio of 1:1.

20. The method of manufacturing a sintered cemented carbide of claim 13, wherein the ceramic hard phase is present in an amount of from 97.25 wt. % to 99.98 wt. % based on a total weight of the sintered cemented carbide.

21. The method of manufacturing a sintered cemented carbide of claim 13, wherein the cemented carbide has a theoretical density of from 15.25 g/cm$^3$ to 17 g/cm$^3$.

22. The method of manufacturing a sintered cemented carbide of claim 13, wherein a cemented carbide composition with improved corrosion resistance is obtained.

23. The method of manufacturing a sintered cemented carbide of claim 13, wherein the Fe—Cr based metallic binder phase is made by blending a FeCr powder with a $Cr_3C_2$ powder.

24. The method of manufacturing a sintered high density cemented carbide of claim 13, wherein the cemented carbide has an HV30 Vickers hardness in a range of from 2227 HV30 to 2700 HV30 and a Palmqvist fracture toughness ($K_{Ic}$) in a range of from 5 MPa√m to 7.6 MPa√m.

25. The method of manufacturing a sintered cemented carbide of claim 13, wherein the drying the slurry blend comprises vacuum drying, air drying, freeze drying, or spray drying through atomization.

26. The method of manufacturing a sintered cemented carbide of claim 13, wherein the sintering comprises hot pressing (HP), hot isostatic pressing (HIP), or spark plasma sintering (SPS).

* * * * *